US005154030A

United States Patent [19]

Harms

[11] Patent Number: 5,154,030

[45] Date of Patent: Oct. 13, 1992

[54] MODULAR OFFICE PARTITIONING SYSTEM

[76] Inventor: John A. Harms, P.O. Box 8, La Mesa, Calif. 92044

[21] Appl. No.: 702,514

[22] Filed: May 20, 1991

[51] Int. Cl.[5] ..... E04B 1/38

[52] U.S. Cl. ..... 52/239; 52/275; 52/578; 52/221

[58] Field of Search ..... 52/274, 275, 239, 578, 52/221

[56] References Cited

U.S. PATENT DOCUMENTS 2,073,781 3/1937 Calafati ..... 52/275
2,076,728 4/1937 Keller ..... 52/275

*Primary Examiner*—James L. Ridgill, Jr.
*Attorney, Agent, or Firm*—Henri J. A. Charmasson

[57] ABSTRACT

A modular living space partitioning system uses a variety of wall panel and wall posts structures, all including several units of a basic structural interface component consisting essentially of a post defining a central interconnecting strip which is oriented at a 45 degree angle with the direction of any wall or panel and two lateral flanges having a equal width corresponding to $\sqrt{2}$ of two times the width of the strip. The basic element can be used on the lateral edges of panels as connectors, or combined two, three, or four at a time to create two, three or four-way right angle connecting pillars.

10 Claims, 2 Drawing Sheets

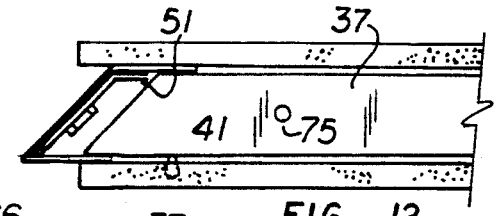
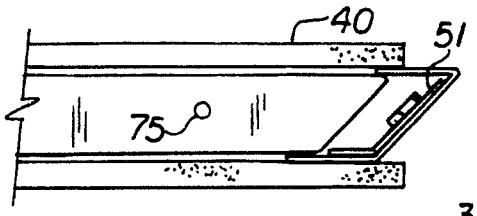
FIG 12
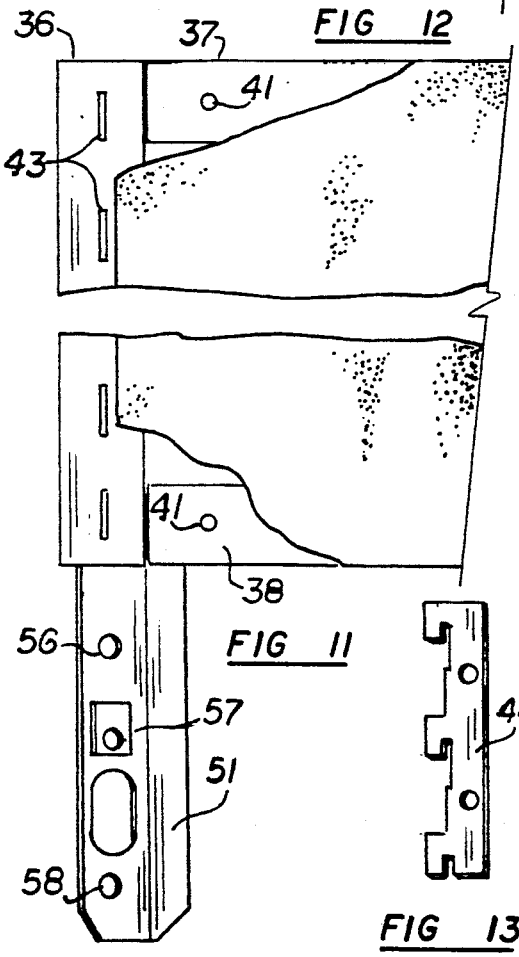
FIG 11
FIG 13
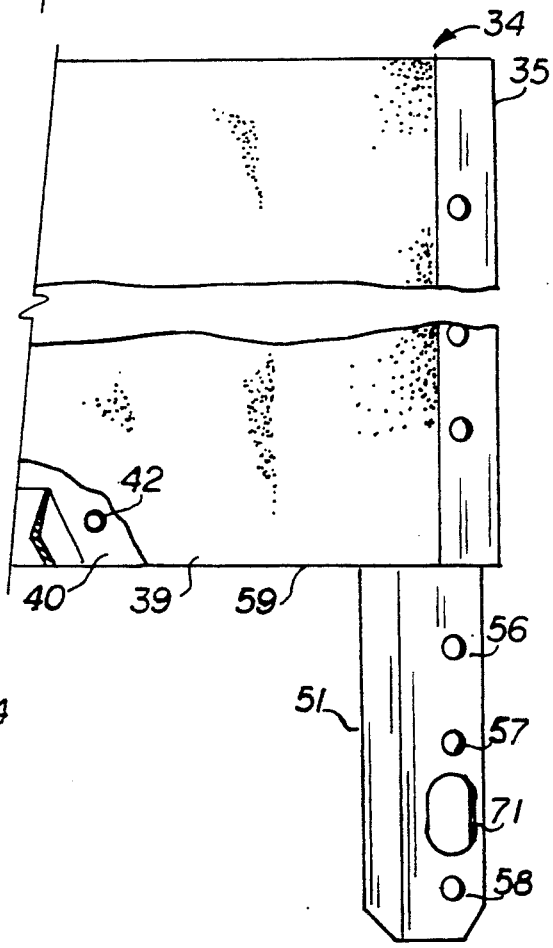
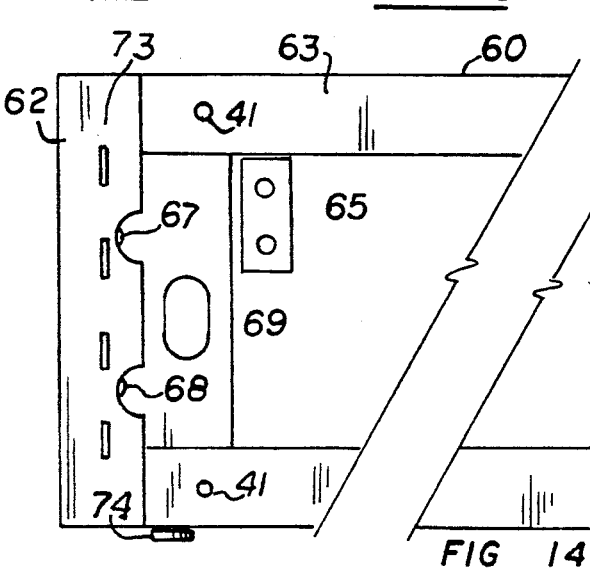
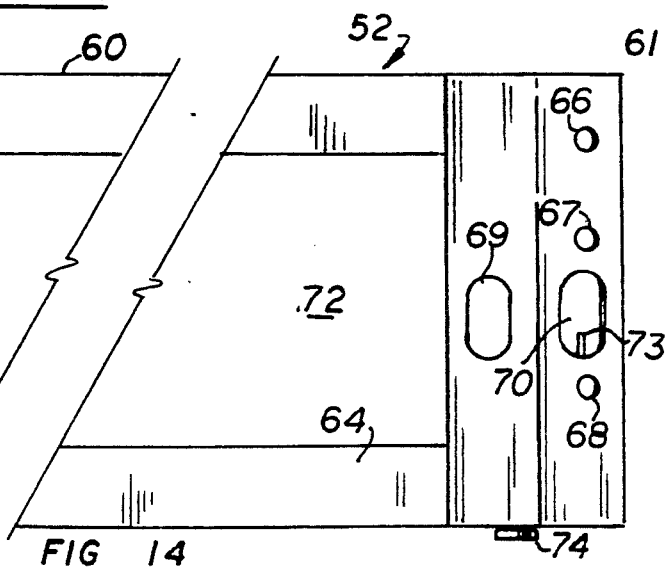
FIG 14

MODULAR OFFICE PARTITIONING SYSTEM

FIELD OF THE INVENTION

This invention relates to living space partitioning systems and more particularly to modular divider kits which may be used to assemble room dividers, counters, displays, work surfaces and other similar structures from a variety of standard components.

BACKGROUND OF THE INVENTION

The prior art systems for assembling temporary or semipermanent living space partitions and work cubicles suffer from a lack of versatility in that they allow the construction of too few basic configurations. Any deviation from those basic configurations require use of additional hardware which increases the assembly time, detract from the styling unity of the original design, and greatly increase the tooling and installation costs. Many of those prior art systems resort to a large number of components which increase the complexity of the assembly. Most significantly, many prior system lack in dimensional consistency between different arrangements of standard elements due to the creeping additions caused by connecting hardware, pillars, corners and other necessary elements of a truly versatile paneling kit. The present invention results from a comprehensive attempt to resolve those problems.

SUMMARY OF THE INVENTION

The principal and secondary objects of this invention are to

- provide a modular partitioning kit with the minimum number of different structural components, and a single, versatile type of connecting interface;
- to maintain dimensional consistency of the paneling under different configurations;
- to prevent light from leaking along interfacing connections and support-bracket slots;
- to allow convenient and easy access to fasteners; and
- to accommodate electrical and plumbing hardware.

These and other objects are achieved by means of a modular partitioning assembly kit having a plurality of interconnectable structures made from several units of a basic building element. That basic building element consists essentially of a vertical interface post which has an interfacing surface at a 45 degree angle with the direction of the wall or panel and two lateral parallel flanges in line with the surface of the wall. This post is welded to the lateral edges of wall panels or used in combination with other posts to form two-way, three-way and four-way right-angle corner pillars. The same model of basic element can indiscriminately be mounted on the right hand or left hand of a structure and has four interconnecting fasteners holes punched at controlled intervals for convenient and rapid combination with the corresponding element of an adjacent structure. An interconnecting plate is used for stacking several heights of wall panels on top of one another. A line of slots along one of the flanges of each basic element provides for the suspension of shelves, table tops and other similar structures by means of a simple universal bracket. This constitutes a set of interconnecting building blocks which can be easily assembled before tiles and other cosmetic elements are added.

BRIEF DESCRIPTION OF THE DRAWING

FIG. 11 is a front elevational view of a wall panel with various cutouts exposing the internal structure;

FIG. 12 is a top plan view thereof;

FIG. 13 is a perspective view of a desk or shelf suspending bracket; and

FIG. 14 is a front elevational view of a base channel.

DESCRIPTION OF THE PREFERRED EMBODIMENT OF THE INVENTION

Figure 2:
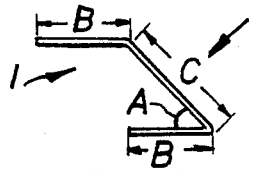
FIG. 2 is a top plan view thereof.
Figure 6:
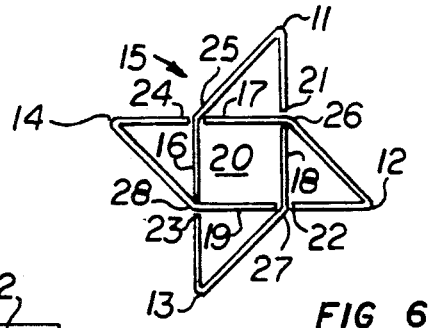
FIG. 6 is a top plan view of a four-way, right-angle interconnecting pillar.
Figure 3:
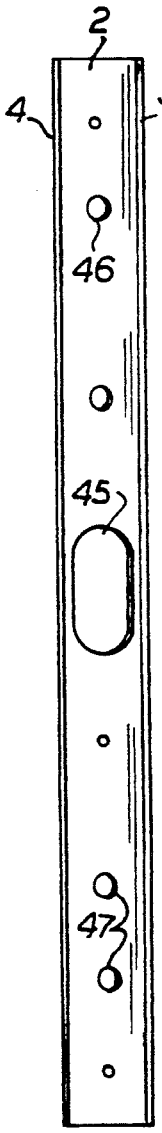
FIG. 3 is a left side view thereof.
Figure 1:
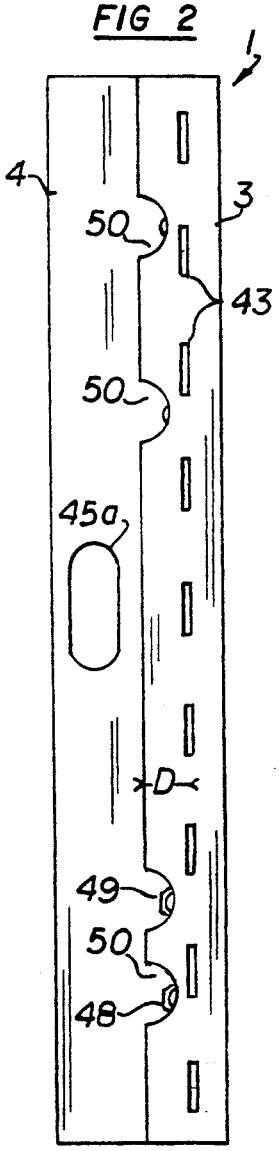
FIG. 1 is a front elevational view of a basic structural and interface component.
Figure 4:
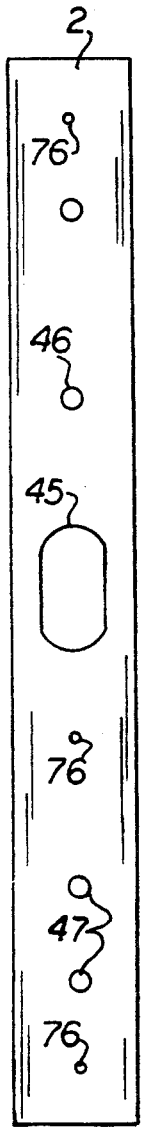
FIG. 4 is a right side view thereof taken in the arrow of FIG. 2.
Figure 8:
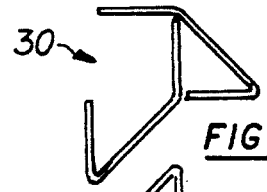
FIG. 8 is a top plan view of a two-way, right, angle interconnecting pillar.
Figure 7:
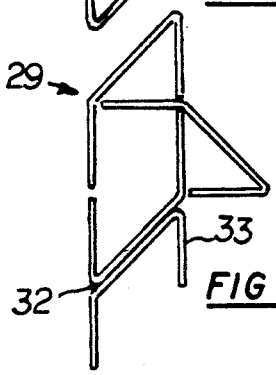
FIG. 7 is a top plan view of a three-way, right-angle interconnecting pillar.
Figure 10:
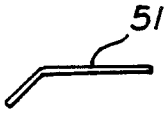
FIG. 10 is a top plan view thereof.
Figure 9:
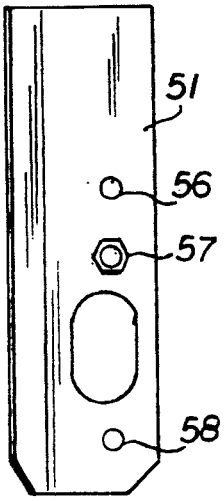
FIG. 9 is a front elevational view of a stacked panel connector.
Figure 5:
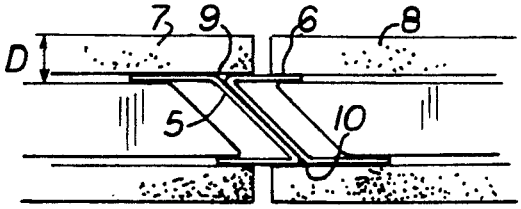
FIG. 5 is a partial cross-sectional view of the interface of two panels.

Referring now to the drawing, the basic structural and interconnecting element which is common to the majority of components of the partitioning assembly kit is specifically illustrated in FIGS. 1–4. This basic component consists essentially of a post 1 which is preferably sheared and punched out of 16 gauge steel then bent to define a central interface strip 2, a first flange 3 bent back over the strip 2 to an angle A of 45 degrees, and a second flange 4 along the opposite edge of the strip so bent in a parallel position to the first flange 3. The width B of both flanges is equal to $\sqrt{2}$ times the width C of the strip 2 after making allowances for he thickness of the material and the bending radii. As illustrated in FIG. 5, the configuration of the basic element 1 allows it to be used as connectors 5, 6 forming the interconnecting edges of wall panels 7, 8 and providing matching interfaces 9, 10 which are oriented at a 45 degree angle to the direction of the wall panels 7, 8. Furthermore, the dimensions and angular orientation of the flanges 2, 3 in relation to the interfacing strip 2 allow the combination of several similar posts to form pillars for supporting and connecting two, three, and four-way, right-angle wall panel arrangements. In FIG. 6, four basic components 11, 12, 13 and 14 are combined together to form a four-way pillar 15 where the second flanges 16, 17, 18 and 19 of the elements form a central square channel 20, and the outer edge 21, 22, 23 and 24 of the first flange of each element abuts the junctions 25, 26, 27 and 28 of the second flange and strip of another basic element. The pillar 29 illustrated in FIG. 7 omits one of the four basic elements 14 of the pillar illustrated in FIG. 6 to provide a three-way, right-angle interconnecting structure. The pillar 30 illustrated in FIG. 8 omits two of the basic elements 11, 14 to form a two-way, right-angle interconnecting structure. As shown in FIG. 7, the oblique outer surface 32 of the interfacing strip of each basic element can be bolted to the corresponding surface of another basic element 33 which may be part of the interface of a wall panel or another pillar.

The construction of a typical wall panel section 34 is illustrated in FIGS. 11 and 12. The panel section is framed on each side by basic elements 35, 36 which are joined along the upper and lower edges by two cross-braces 37, 38 made from square tubing stock. Wallboards or tile 39, 40 are applied on the front and back faces. The wallboards are secured by detent nibs 41 mounted on the braces 35, 36 and engaging eyelets 42 in the backs of the wallboards. The wallboards are made of wood or synthetic material and may be painted or covered with wall covering. Each wallboard extends laterally up to the inner edge of a row of slots 43 which run down the first flage of each basic element parallel and spaced-apart from the junction of that first flange and the connecting strip. These slots are used to suspend shelves, desk-top or other similar structures equipped with the bracket 44 illustrated in FIG. 13.

In lieu of a pair of front and back wallboards, each wall panel may be covered by a pair of flanged elements forming the frame of a pass-through window. This feature combined with a wallboard thickness D substantially equal to the distance between the row of slots and the outer edge of the first flange, preserve the dimensional consistency of any set of panels either in line or in right-angle arrangements. There is no need to account for any so-called "panel-creep"; i.e. space added by joints and pillars.

Apertures 45 and 45*a* cut through each basic element are spaced and dimensioned to allow passage for several electrical cables and their connectors. Two pairs of spaced-apart holes 46, 47 along the median line of each interconnecting strip 2 provides passage for the fastening bolts. Nuts 48, 49 may be welded in the back face of the strip in line with some of the holes to facilitate assembly. Semi-circular cutouts 50 in the outer edge of the first flange are positioned and sized to allow easy access to the fastening bolts with a socket wrench, as well as a convenient alignment of the sockets.

If the panel is to be stacked on top of another, a connecting plate 51 is welded inside the lower end of each basic element 35, 36. The connecting plate has holes 56, 57, 58 which line up with the holes 46 in the basic element of the panel below it.

A small strip 59 of resilient foam may be applied under the lower cross-braces 38 in order to prevent light from bleeding between an upper and lower panel. All the other interfaces using the basic element 2 are totally free of any interstices through which light could pass between two sides of a wall. The connecting plates 51 are also used to connect the panels to a base utility channel 52 illustrated in FIG. 14.

The utility channel 52 has the same basic configuration as a wall panel, but has a much reduced height which usually does not exceed 15 cm. When the upper edge 60 of the channel is in contact with the foam strip 59 at the bottom of a wall panel, the two lateral pillars 61, 62 engage the connecting plates 51. The connecting holes 56, 57 and 58 of the sleeves line up with corresponding holes 66, 67 and 68 in the channel pillars. The top and bottom cross-braces 63, 64 are exactly similar to the cross-braces 37 and 38 of the wall panel. A bracket 65 welded to the bottom surface of the upper cross-brace 63 is positioned and dimensioned to provide a convenient attachment for an electric switch box. Holes 69 and 70 punched through the pillars 61, 62 line up with commensurate holes 71 in the connecting plates 51 to provide a convenient pass-through for electrical wiring into the channel 72 defined between the top and bottom cross-braces 63, 64. The pillars 61, 62 have a row of slots 73 which line up with the slots 43 in the pillars 35, 36 of the wall panel. The cross-braces have the same detent nib 41 as the cross-brace of the wall panel for attaching tiles and other surface elements. Accordingly, the tile of a lowermost wall panel in a wall can be extended to cover the utility channel 52. Alternately, the utility channel can be covered with its own smaller tile or other convenient facing. Levelers 74 with rubber feet are mounted against the bottom surface of the bottom cross-brace 74.

In addition to the tiles or wallboards covering the front and back face wall panel or utility channel, capping elements, not illustrated in the drawing, are also provided to cover the exposed lateral and upper edges of each panel. Holes 75 are provided along the top cross-brace of each panel for fixing the capping elements.

The height of each basic component or post 1 is preferably inches (40.64 centimeters). Standard widths may vary from 18 inches (45.72 centimeters) to 48 inches (126.72 centimeters) in increments of 6 inches (15.24 centimeters). Small holes 76 are punched along the median line of each interfacing strip 2 to help in aligning adjacent posts together.

While the preferred embodiment of the invention has been described, modifications can be made and other embodiments may be devised without departing from the spirit of the invention and the scope of the appended claims.

What is claimed is:

1. A modular partitioning assembly which comprises a plurality of interconnectable structures wherein each of said structures includes at least two identical basic building elements, each of said basic building elements comprising:

a length of solid fat strip having a constant width;

a first flange projecting at a 45 degree angle from a longitudinal edge of the strip;

a second flange projecting parallelly to the first flange from the opposite longitudinal edge of the strip;

wherein the width of each said first and second flange is substantially equal to $\sqrt{2}$ times the width of the strip; and means along said strip for connecting to another basic element belonging to another structure.

2. The assembly of claim 1, wherein said interconnectable structures comprises a two-way right-angle connecting pillar comprising:

first and second of said basic elements joined in a right angle configuration wherein the second flange of the first basic element bridges the space between the junction of the strip and second flange of the second basic element and the lateral edge of the first flange of the second basic element, and the junction of the strip and second flange of the first element abuts said lateral edge.

3. The assembly of claim 1, wherein said interconnectable structures comprise a three-way, right-angle connecting pillar comprising:

first, second and third of said basic elements joined in a right-angle configuration wherein the second flange of the first basic element bridges the space between the junction of the strip and second flange of the second element and the lateral edge of the first flange of the second element, the junction of the strip and second flange of the first element abuts said lateral edge, and the second flange of the third element bridges the space between the junction of the strip and second flange of the first element and the lateral edge of the first flange of the first element, and the junction of the strip and second flange of the third element abuts the lateral edge of the first element.

4. The assembly of claim 1, wherein said interconnectable structures comprise a four-way, right-angle interconnecting pillar comprising:

first, second, third and fourth basic elements joined in a right-angle configuration wherein the second flanges of said elements form a quadrangular, square channel, the junction of each second flange and strip in a basic element abutting the outer edge of the first flange of another basic element.

5. The assembly of claim 1, wherein said interconnectable structure comprises a wall panel having:

a pair of said basic elements, each forming a lateral edge of the panel;

a pair of spaced-apart cross-braces having each end joined to the second flange of one of the basic elements, wherein each of said cross-braces has a quadrangular cross-section of the same width between a front and a back face as the width of said flange, and each of said faces lies in the same plane as one of said flanges.

6. The assembly of claim 1, wherein said wall panel comprises a rectangular wallboard; and means for securing said wallboard to said wall-panels.

7. The assembly of claim I, wherein the wallboard is shaped and dimensioned so that the lateral edges of said wallboard secured to the cross-braces, line up with the outer edge of said slots.

8. The assembly of claim 1, wherein each of said basic elements has a series of longitudinal slots in its first flange, said slots being aligned along a line spaced-apart from and parallel to the junction of the first flange and the strip; and wherein said means for connecting comprise said strip having a first pair of spaced-apart holes in a first half of the strip and a second pair of spaced-apart holes in the other half of said strip, said pairs of hole being lined up along a line passing through the longitudinal center of the strip.

9. The assembly of claim 8, which further comprises a plurality of electrical cables running through at least one of said basic elements, wherein the strip of each of said basic elements has an opening sized and dimensioned to allow passage of said electric cables.

10. The assembly of claim 9, wherein the outer edges of said first and second flanges have semi-circular access notches in line with said pairs of holes.

* * * * *